US008650670B2

(12) United States Patent
Stein

(10) Patent No.: US 8,650,670 B2
(45) Date of Patent: Feb. 18, 2014

(54) AIR BLASTING DEVICES FOR PLUMBING PURPOSES TO CLEAN, CLEAR, UNCLOG, OR UNSTOP DRAINS OR PIPES

(76) Inventor: Harvey Lewis Stein, Annapolis, MD (US)

( * ) Notice: Subject to any disclaimer, the term of this patent is extended or adjusted under 35 U.S.C. 154(b) by 0 days.

(21) Appl. No.: 13/589,288

(22) Filed: Aug. 20, 2012

(65) Prior Publication Data

US 2013/0067650 A1 Mar. 21, 2013

Related U.S. Application Data

(60) Division of application No. 12/859,415, filed on Aug. 19, 2010, now Pat. No. 8,307,468, which is a continuation-in-part of application No. 12/571,781, filed on Oct. 1, 2009, now Pat. No. 8,245,329.

(51) Int. Cl.
*E03D 11/00* (2006.01)

(52) U.S. Cl.
USPC ..... 4/255.11

(58) Field of Classification Search
USPC ..... 4/255.11, 255.01
See application file for complete search history.

(56) References Cited

U.S. PATENT DOCUMENTS

| | | | | |
|---|---|---|---|---|
| 1,900,275 | A * | 3/1933 | Carter et al. | 134/166 C |
| 5,423,621 | A | 6/1995 | Russell | |
| 6,055,680 | A | 5/2000 | Tolbert | |
| 6,898,807 | B2 * | 5/2005 | Tash | 4/255.01 |
| 6,989,807 | B2 * | 1/2006 | Chiang | 345/82 |
| 7,089,605 | B2 | 8/2006 | Jiang | |
| 7,299,519 | B1 | 11/2007 | Garry | |
| D575,914 | S * | 8/2008 | Carty | D32/14 |
| 7,752,684 | B1 * | 7/2010 | Pieretti | 4/255.11 |

* cited by examiner

*Primary Examiner* — Huyen Le
(74) *Attorney, Agent, or Firm* — John D. Gugliotta, PE, Esq.

(57) ABSTRACT

An improved plunger comprises a generally V-shaped handle attached to a top distal end of a shaft. The handle comprises two mirrored arms that face inwards from a base so that neither of them nor the shaft shares a vertical or a horizontal plane. The handle is removably detachable from the plunger so that it can be washed, disinfected, and sanitized. At least one extension shaft portion extends a height of the shaft when it is not collapsed into and housed in the hollow shaft. A snaking attachments formed of a linearly aligned, spiral wound coil has an attachment end attachable to said dislodging protrusion.

20 Claims, 5 Drawing Sheets

AIR BLASTING DEVICES FOR PLUMBING PURPOSES TO CLEAN, CLEAR, UNCLOG, OR UNSTOP DRAINS OR PIPES

RELATED APPLICATIONS

The present invention is a Continuation in Part of U.S. Ser. No. 12/859,415, which was a continuation in part U.S. Pat. No. 8,245,329 filed on Oct. 1, 2009, all of which claim benefit of U.S. Provisional Patent No. 61/101,742 filed Oct. 1, 2008. Both U.S. Pat. No. 8,245,329 and U.S. Ser. No. 12/859,415 are incorporated by reference herein as if fully rewritten.

BACKGROUND OF THE INVENTION

1. Field of the Invention

The present invention relates generally to air blasting devices for plumbing purposes that clean, clear, unclog, or unstop drains or pipes and, more specifically, to improved devices having increased volumetric displacement, handle arms and a shaft all in separate planes, and attachable snaking devices for concurrent deployment.

2. Description of the Related Art

Toilet plungers are often found in near proximity to most restrooms, utility drains, and garbage disposals to remedy any unsightly, malicious blockages which tend to cause the plumbing system to fail. The most widely used plunger is a standard design having two components: a distal bottom of a generally vertical, wooden shaft attached to a crest of a plunger portion. There are a variety of designs for plunger portions, but they namely comprise inverted rubber cups with flat rims or flanges that form seals over the mouth of a drain or pipe. A push of the shaft towards the mouth causes the cup to depress, which forces any air and/or water therein towards the blockage to break up the clog.

An effective plunge is dependent on both the vacuum formed by the seal and the degree of force used on the shaft. The present invention discloses an improved handle atop the shaft, which provides a better and more ergonomic means to manipulate the plunger. A further feature of the present invention includes a dislodging protrusion that shares a longitudinal axis with the shaft. The dislodging protrusion protrudes downwards from the plunger cup to just beneath the crest. Formed as a dull spike that protrudes past the cross-plane formed at the cup's rim(s) when the plunger is compressed, the dislodging protrusion physically breaks up clogs. Yet a further feature of the present invention is the incorporation of a snaking attachments that is removably affixable to the dislodging protrusion. The snaking attachment provides a linearly elongated plumbing snake mechanism that may extend further into a plumbing conduit in order to physically break up clogs that may be located distally further than the dislodging protrusion can reach.

SUMMARY OF THE INVENTION

The present invention relates generally to an improved air blasting device for plumbing purposes, which cleans, clears, unclogs or unstops drains or pipes.

It is a feature of the present invention to provide a plunger having a construction that provides for increased volumetric displacement.

It is an object of the invention to provide an improved shaft portion which further provides for better and more forceful plunges.

It is an object of the present invention to provide an improved handle portion that is inclined and inward facing to provide the user with a more ergonomic grasp, as well as to provide for a more forceful plunge.

It is yet another object of the present invention to provide a dislodging protrusion that protrudes downwards from the plunger to aid in physically breaking up clogs.

It is a final object of the present invention to provide a snaking attachment that is attachable to the dislodging protrusion that may extend further into a plumbing conduit, to additionally aid in physically breaking up clogs.

BRIEF DESCRIPTION OF THE DRAWINGS

Advantages and features of the present invention are better understood with reference to the following and more detailed description and claims taken in conjunction with the accompanying drawings, in which like elements are identified with like symbols, and in which:

DESCRIPTION OF THE PREFERRED EMBODIMENTS

Figure 1:
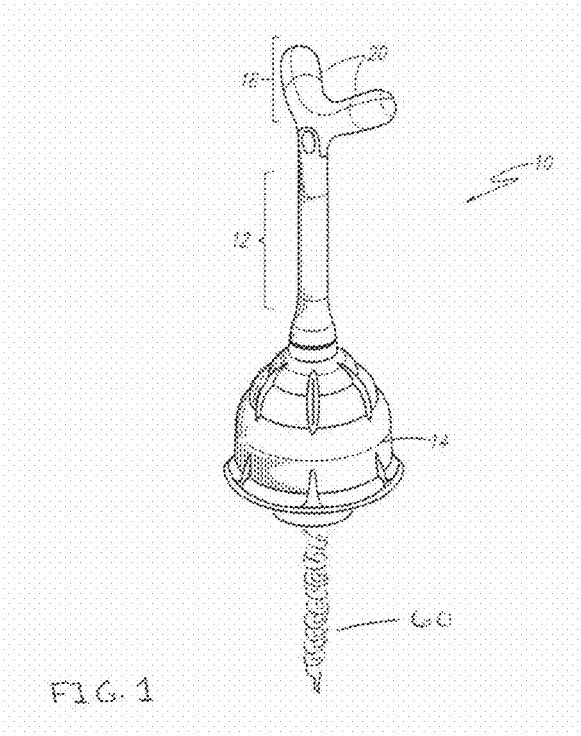
FIG. 1 is a perspective view of an improved plunger according to a preferred embodiment of the present invention.
Figure 2:
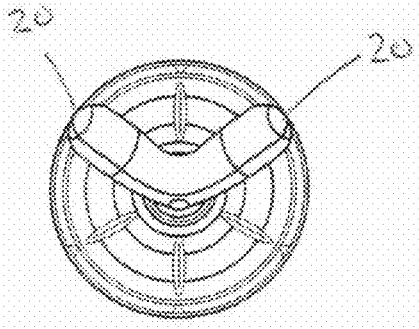
FIG. 2 is a top view thereof.
Figure 3:
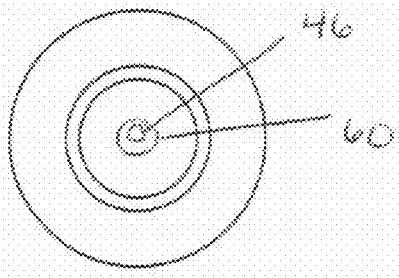
FIG. 3 is a bottom view thereof.
Figure 4:
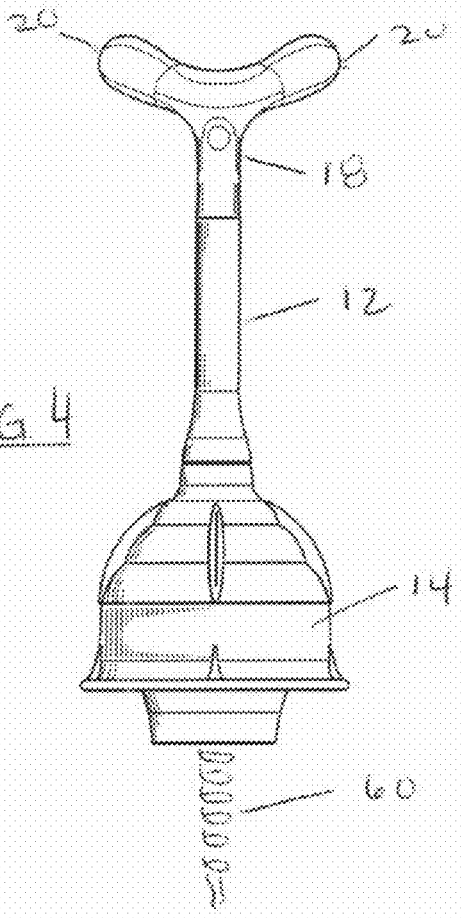
FIG. 4 is a front view thereof.
Figure 5:
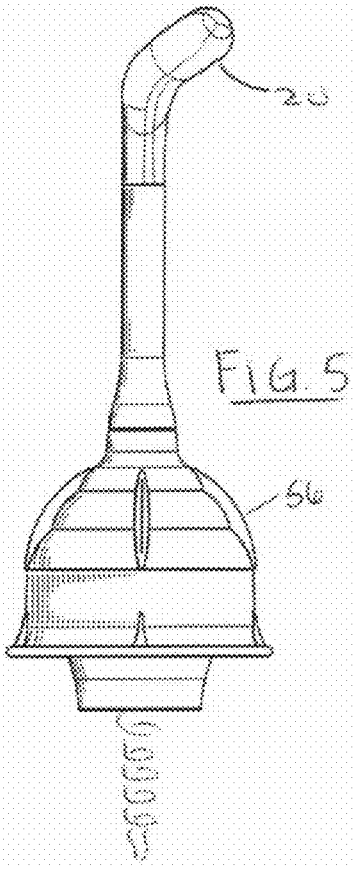
FIG. 5 is a side view thereof.

The best mode for carrying out the invention is presented in terms of its preferred embodiment, herein depicted within the Figures.

1. Detailed Description of the Figures

A preferred embodiment of the present improved air blasting device for plumbing purposes is hereinafter referred to as a plunger 10 for convenience, and it is shown in FIGS. 1-8 according to the present invention. The plunger 10 is shown to comprise a shaft 12 (hereinafter synonymously referred to as "stem") vertically extending upwards from a crest of an improved, inverted rubber plunger cup 14.

A handle 18 is attached to the top distal end of the shaft 12. The handle 18 is a generally a V-shaped handle having mirrored arms 20 that face inwards (refer to FIG. 2). The effect of the angled inward V-shaped arms 20 is that neither of them nor the shaft 12 shares a vertical or a horizontal plane; hence, all of the arms and the shaft travel in separate planes. Each of the arms 20 angle inwards (refer to FIG. 5), where it is anticipated a user stands relative to the plunger 10. The angling and/or over-molding of the arms 20 both provide the user with a more ergonomic grasp of the handle. It keeps the user's hands off of the shaft 12. It provides the user with a two-handed plunge with a greater force towards the mouth of the to-be-plunged pipe. A second advantage of the arms angled inwards is that the user does not need to hover over the plunger in a manner similar to that for conventional plungers; rather, the user can simply extend forearms outwards so that there is less risk of any splatter on his or her upper-attire.

Figure 6:
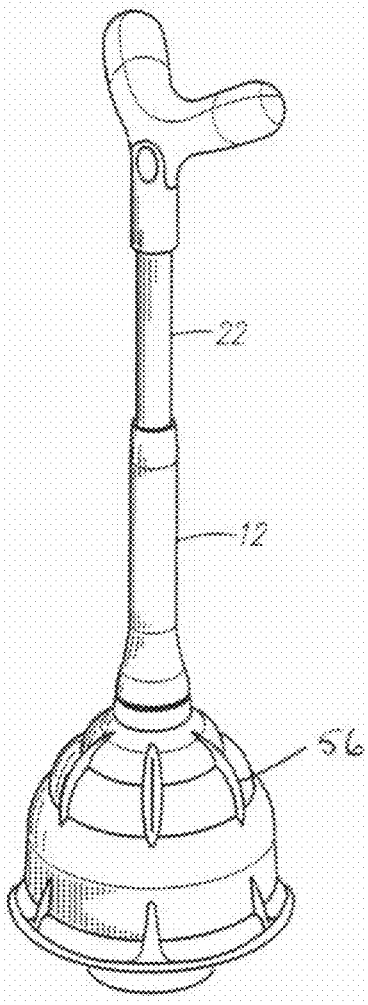
FIG. 6 is an elevational view of the plunger comprising an extension shaft portion.
Figure 7:
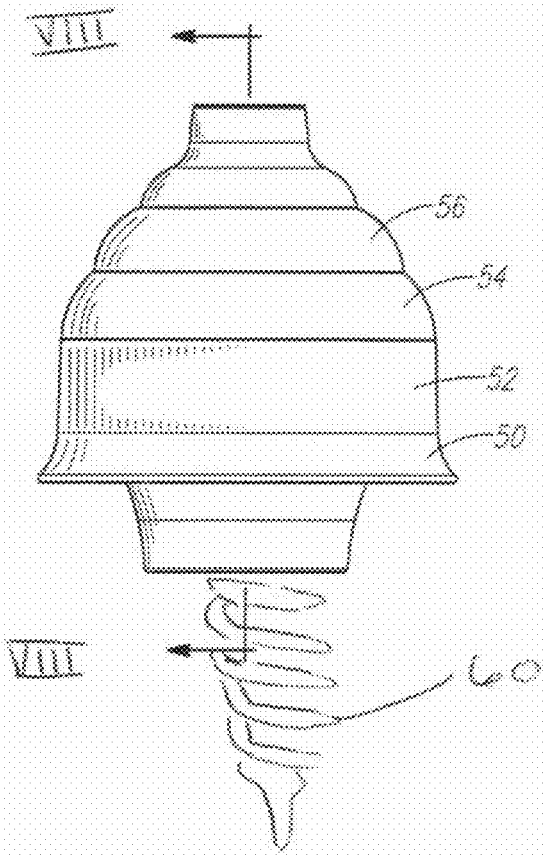
FIG. 7 is a side view of the cup portion.
Figure 8:
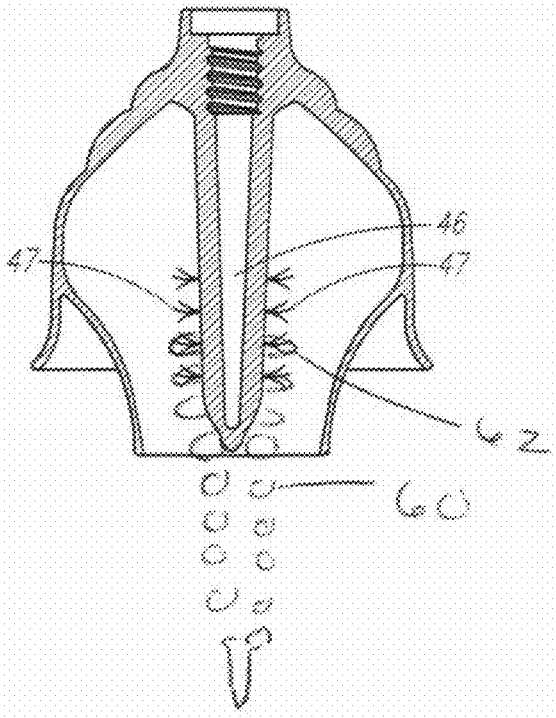
FIG. 8 is cross-section of the cup taken along lines VIII-VIII in FIG. 7.
Figure 9A:
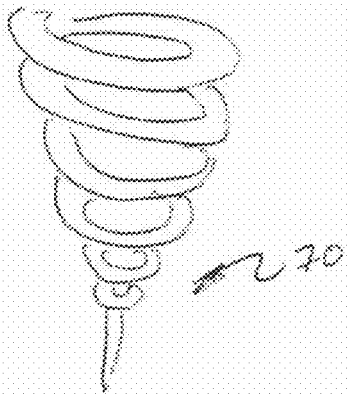
FIG. 9*a* through FIG. 9*d* are perspectives view of additional alternate embodiments of snaking attachments for use in conjunction with the present invention.
Figure 9B:
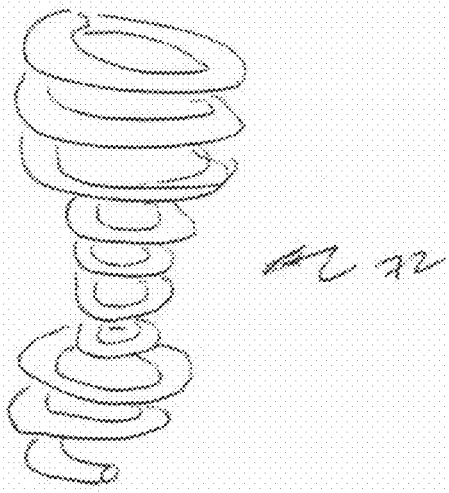
Figure 9C:
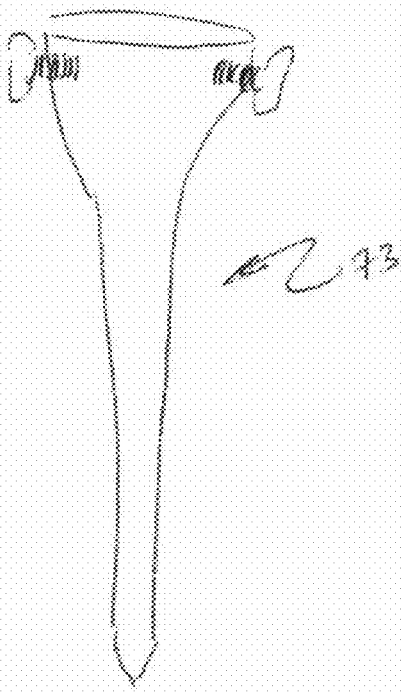
Figure 9D:
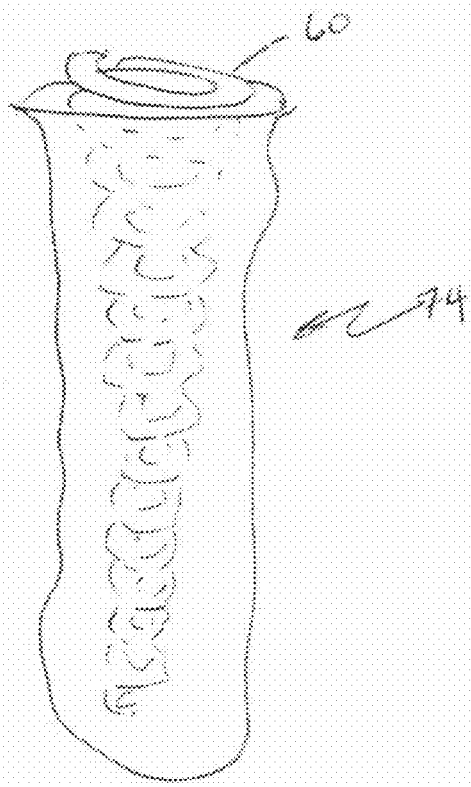

Another feature of the improved plunger 10 is an improved shaft 22. In its preferred embodiment, the shaft 22 terminates at its lowermost end as a smooth transition to the upper crest of the plunger cup 14. The smooth transition prevents an accumulation of waste or unsanitary water within any ledges, notches, cavities or the like. An alternate embodiment anticipates at least one extension shaft portion 22. The extension shaft portion 22 is shown in FIG. 6 to extend a height of the shaft 12. The extension shaft portion 22 can remain extended on the shaft 12 for use, or it can retract to allow the entire device to be easily stored under a sink or vanity. Alternate embodiments may include only one fixed, non-collapsible length of shaft that equals the present main shaft and extended shaft combined. In operation, the extension shaft portion 22 collapses for storage in the shaft 12, where the former and the latter essentially act as telescoping members. A threaded rod is an attachment means that is used to connect the shaft 12 to the plunger 14.

It is anticipated that another feature of the improved plunger 10 is the improved plunger cup 14, which forms an increased volumetric capacity. A typical cup comprises a continuous sidewall that extends nearly vertically upwards a height before it tapers to a horizontal plane proximate to the crest. The present cup, as best shown in conjunction with FIG. 7, comprises rim 50 that forms an 'O-ring' type bead about the outer circumferential edge in a manner that flanges outwards before a first continuous sidewall 52 extends nearly vertically upwards and curves gradually to taper to a horizontal plane. The continuous sidewall 52 next extends nearly vertically upwards to extend a height, and hence a volume, of the plunger cup 14. Radially spaced about the outer surface of the sidewall 52 are a series of ribs 56. The ribs 56 are formed along the vertical centerline of the plunger cup 14 as a thickened protrusion of the sidewall 52 and provide a rebound resiliency to the sidewall 52. It has been found that the use of such ribs 56 prevents collapse of the sidewall 52 when the plunger cup is depressed, thereby allowing for the sidewall to rebound to its original shape, as well as to aid in created a seal between the rim 50 and the inside of a sink or toilet surface. Additionally, as best shown in conjunction with FIG. 10, radially spaced about the inner surface of the sidewall 52 are a series of similarly formed ribs 54, again to aid in allowing for the sidewall to rebound to its original shape s well as to aid in creating a seal between the rim 50 and the inside of a target surface.

The plunger cup 14 is shown to comprise the foregoing features; however, embodiments including the handle and the shaft feature of this invention may be utilized with alternate cup designs including, but not limited to, conventional flanged and flat rimmed cups.

A further feature of the present invention includes a dislodging protrusion 46 that shares a longitudinal axis with the shaft 12. As best shown in conjunction with FIG. 8, the dislodging protrusion 46 protrudes downwards from the inner-sidewall of the plunger cup 14 just beneath the crest. Ideally, it extends from an underside of the bottom-wall of the cavity. The dislodging protrusion 46 is preferably a dull spike that protrudes past the cross-plane formed at the cup's rim(s) when the plunger is compressed. The dislodging protrusion 46 is shown herein as being formed as a dull spike to physically break up clogs. In further embodiments, the dislodging protrusion 46 may comprise stiff bristles that extend outwards from at least a portion of its surface. It is anticipated that the bristles can catch hair that clogs sing and shower drains, so that it can be pulled out therefrom.

Further shown as part of the present invention is the incorporation of a snaking attachments 60. As shown throughout FIG. 1-8, a preferred embodiment of a snaking attachment 60 is shown as a linearly aligned, spiral wound coil. An attachment end 62 is attachable to the dislodging protrusion 46, and as shown in the preferred embodiment a spiral metal coil can have an attachment end that can physically impinge about the dislodging protrusion. As would be obvious to a person having ordinary skill in the relevant art, in light of the present teachings and disclosure, it would be anticipated that mechanical fasteners or other attachment mechanisms of the snaking attachment 60 onto the dislodging protrusion 46 should be considered equivalent to enable the features and functions intended.

In any variation, the snaking attachment provides a linearly elongated plumbing snake mechanism that may extend further into a plumbing conduit in order to physically break up clogs that may be located distally further than the dislodging protrusion can reach. It is anticipated that a number of additional features and functions may be further incorporated by way of additional design improvement to the snaking attachment 60. By way of example, and not as a limitation, FIG. 9*a* through FIG. 9*d* depict alternate embodiments of the snaking attachment, including such features as having a cone-shaped coiled extension mechanism 70, a coiled extension that has an increased diameter at the distal end 72, or a solid walled, mechanically affixed extension spike 73. In further embodiments, the snaking mechanism 60 may be utilized in conjunction with a disposable sheath 74 formed of a lightweight, thin-walled plastic in order to provide a mechanism for preventing any clogging material that may be present within the targeted drain from contaminating or soiling the snaking mechanism 60.

2. Operation of the Preferred Embodiment

To use the present invention, the plunger is removed form its storage location in the collapsed state. The handle is used to pull the extension shaft portion upwards and away from the temporary housing in the main shaft portion. The extension shaft portion is rotated to secure the extension shaft portion maintains the extended height of the shaft. The flange or the rim of the plunger cup is sealed over the mouth of a toilet pipe or drain with the arms of the inward-facing V-shaped handle facing towards or away from the user, which ever grip is more comfortable to the user. The user wraps each hand around one of the arms and pushes downwards on them to force a plunge. The plunger cup depresses in a manner similar to other plunges to loosen a clog, but with a larger volume of air and pressure generated.

In the event that the clog remains after the force of the plunge and physical action of the dislodging protrusion 46, the user may further utilize snaking attachments 60 in conjunction with subsequent plunges. A snaking mechanism may be affixed such as to extend from the dislodging protrusion and guided downward into the targeted plumbing conduit at issues, and the plunging process repeated with the linearly elongated plumbing snake mechanism extending further down into the plumbing conduit in order to physically break up clogs that may be located distally further than the dislodging protrusion can reach.

Whether used with or without the snaking attachment 60, after the blockage is removed, the user can unscrew the handle from the top portion of the extension shaft arm to wash and disinfect it. After the handle is reassembled thereon, the extension shaft portion is rotated in a counter direction so that it can collapse into the shaft. The plunger is placed in the concealed storage location.

The foregoing descriptions of the specific embodiments of the present invention have been presented for the purposes of illustration and description. They are neither intended to be exhaustive nor to limit the invention to the precise forms disclosed and obviously, many modifications and variations are possible in light of the above teachings. The embodiments were chosen and described in order to best explain the principles of the invention and its practical application, to thereby enable others skilled in the art to best utilize the invention and its various embodiments with various modifications as are suited to the particular use contemplated. It is intended that the scope of the invention be defined by the Claims appended hereto and to their equivalents. Therefore, the scope of the invention is to be limited only by the following claims.

Having thus described the invention what is claimed as new and desired to be secured by Letters Patent is as follows:

1. In a plunger having an inverted rubber cup having a rim about a mouth of the cup and circumscribing a formed continuous plunger wall, said rubber cup connected to a distal end of a linearly elongated shaft such that forcible deformation of the rubber cup plunger wall is capable of creating increased pressure when the mouth of the cup is sealed about a plumbing opening, wherein the improvement comprises, in combination:

an improved generally V-shaped handle atop the shaft and attached to a top distal end of said shaft, which provides a better and more ergonomic means to manipulate the plunger;

a dislodging protrusion integrated within the inverted rubber cup and sharing a longitudinal axis with the shaft; and a snaking attachments capable of being removably affixed to said dislodging protrusion, wherein said snaking attachment provides a linearly elongated plumbing snake mechanism that may extend into a plumbing conduit in order to physically break up clogs.

2. The improved plunger of claim 1, wherein said dislodging protrusion protrudes downwards from the plunger cup to just beneath the crest forming a dull spike that protrudes past a cross-plane formed at the cup's rim(s) when the plunger is compressed.

3. The improved plunger of claim 1, wherein said snaking attachments comprises a linearly aligned, spiral wound coil having an attachment end attachable to said dislodging protrusion.

4. An improved plunger comprising:

a hollow shaft vertically extending upwards from a crest of an inverted rubber plunger cup;

a dislodging protrusion protruding downwards from said plunger cup;

a generally V-shaped handle attached to a top distal end of said shaft, wherein said handle comprises: two mirrored arms that face inwards so that neither of said arms nor said shaft share a vertical or a horizontal plane; hence, an of the arms and the shaft travel in separate planes, said handle further is removably detachable from said plunger so that it can be washed, disinfected, and sanitized;

a base that is a leg vertically extending downwards a length where said arms meet;

at least one extension shaft portion to extend a height of said shaft;

a threaded rod to connect said shaft to said plunger;

a cavity at a crest of said plunger cup that travels a vertical depth to accommodate a first length of said threaded rod, wherein said first length of said threaded rod comprises a circumference slightly smaller than that of said cavity;

a second, remaining length of said threaded rod comprising a second circumference slightly smaller than that of a hollow depth protruding from at least at a distal end of said shaft, wherein said depth at said distal end of said shaft comprises corresponding threads along an inner shaft wall which mate with those on said second, remaining length; and a snaking attachments capable of being removably affixed to said dislodging protrusion;

wherein said snaking attachment provides a linearly elongated plumbing snake mechanism that may extend into a plumbing conduit in order to physically break up clogs; and wherein said cavity comprises corresponding threads across its inner wall that mate with those on said first length of the rod; and wherein said cavity receives said first length of said rod while said second, remaining length is received in said depth of said shaft.

5. The plunger of claim 4, wherein said shaft comprises a cross-section slightly greater than that of said extension shaft portion so that a latter can collapse into and be housed in a former.

6. The plunger of claim 4, wherein said extension shaft portion comprises a threaded distal length that mates with corresponding threads along an inner cavity wall formed at a base of said handle.

7. The plunger of claim 4, wherein a lower distal end of said extension shaft portion comprises a threaded length that mates with a corresponding threaded length comprised on an inner shaft wall proximate to a corresponding top distal end of said shaft.

8. The plunger of claim 4, wherein said plunger cup further comprises:

a rim that flanges outwards before a first continuous sidewall extends nearly vertically, upwards;

a second continuous sidewall affixed to said first sidewall where said first continuous sidewall begins to taper to a horizontal plane, said second continuous sidewall next extends nearly vertically upwards to extend a height, and hence a volume, of said plunger cup; and, a third continuous sidewall affixed to said second continuous sidewall when said second continuous sidewall begins to taper another horizontal plane, said third continuous sidewall tapers inward toward and travels a short distance in a third horizontal plane before it tapers again upwards in a vertical plane where it terminates at a mouth of a cavity;

wherein each of said continuous sidewalls comprises a circumference smaller than a last such that said plunger cup is embodied as a plurality of concentric, stacked sidewalls.

9. The plunger of claim 4, wherein said dislodging protrusion shares a longitudinal axis with said shaft, said dislodging protrusion protrudes downwards from an inside of a continuous sidewall of said plunger cup just beneath the crest; wherein said dislodging protrusion protrudes past a cross-plane formed at said plunger cup's rim when said plunger is compressed.

10. The plunger of claim 9, wherein said dislodging protrusion comprises stiff bristles that extend outwards from at least a portion of its surface.

11. The plunger of claim 4, further comprising:

a shaft vertically extending upwards from a crest of an inverted rubber plunger cup, wherein said plunger cup comprises:

a rim that flanges outwards before a first continuous sidewall extends nearly vertically upwards;

a second continuous sidewall affixed to said first sidewall where said first continuous sidewall begins to taper to a horizontal plane, said second continuous sidewall next extends nearly vertically upwards to extend a height, and hence a volume, of said plunger cup; and, a third continuous sidewall affixed to said second continuous sidewall when said second continuous sidewall begins to taper another horizontal plane, said third continuous sidewall tapers inward toward and travels a short distance in a third horizontal plane before it tapers again upwards in a vertical plane where it terminates at a mouth of a cavity;

wherein each of said continuous sidewalls comprises a circumference smaller than a last such that said plunger cup is embodied as a plurality of concentric, stacked sidewalls.

12. The plunger of claim 11, wherein said shaft further comprises a generally V-shaped handle attached to a top distal end of said shaft.

13. The plunger of claim 12, wherein said handle comprises:

two mirrored arms that face inwards so that neither of said arms nor said shaft share a vertical or a horizontal plane; hence, all of the arms and the shaft travel in separate planes; and, a base that is a leg vertically extending downwards a length where said arms meet.

14. The improved plunger of claim 4, wherein said snaking attachments comprises a linearly aligned, spiral wound coil having an attachment end attachable to said dislodging protrusion.

15. In a plunger having an inverted rubber cup having a rim about a mouth of the cup and circumscribing a formed continuous plunger wall, said rubber cup connected to a distal end of a linearly elongated shaft such that forcible deformation of the rubber cup plunger wall is capable of creating increased pressure when the mouth of the cup is sealed about a plumbing opening, wherein the improvement comprises, in combination:

a dislodging protrusion extending from within the inverted rubber cup and sharing a longitudinal axis with the shaft; and a snaking attachments capable of being removably affixed to said dislodging protrusion, wherein said snaking attachment provides a linearly elongated plumbing snake mechanism that may extend into a plumbing conduit in order to physically break up clogs.

16. The improved plunger of claim 15, wherein said dislodging protrusion is integrated within the inverted rubber cup.

17. The improved plunger of claim 16, wherein said dislodging protrusion protrudes downwards from the plunger cup to just beneath the crest forming a dull spike that protrudes past a cross-plane formed at the cup's rim(s) when the plunger is compressed.

18. The improved plunger of claim 15, wherein said dislodging protrusion is removably attachable to within the inverted rubber cup.

19. The improved plunger of claim 18, wherein said dislodging protrusion protrudes downwards from the plunger cup to just beneath the crest forming a dull spike that protrudes past a cross-plane formed at the cup's rim(s) when the plunger is compressed.

20. The improved plunger of claim 15, wherein said snaking attachments comprises a linearly aligned, spiral wound coil having an attachment end attachable to said dislodging protrusion.

* * * * *